US008733802B2

(12) United States Patent
Promutico et al.

(10) Patent No.: US 8,733,802 B2
(45) Date of Patent: May 27, 2014

(54) DOOR-LOCKING DEVICE FOR LOCKING THE DOOR OF HOUSEHOLD APPLIANCE

(75) Inventors: Fabrizio Promutico, Turin (IT); Gianpaolo Barone, Turin (IT); Andrea Saccocci, Turin (IT)

(73) Assignee: Bitron S.p.A., Turin (IT)

( * ) Notice: Subject to any disclaimer, the term of this patent is extended or adjusted under 35 U.S.C. 154(b) by 0 days.

(21) Appl. No.: 13/481,805

(22) Filed: May 26, 2012

(65) Prior Publication Data

US 2012/0292924 A1 Nov. 22, 2012

Related U.S. Application Data

(63) Continuation of application No. PCT/IT2010/000426, filed on Oct. 21, 2010.

(30) Foreign Application Priority Data

Nov. 26, 2009 (IT) ..... RM2009A0622

(51) Int. Cl.
*E05C 5/02* (2006.01)
*E05C 19/10* (2006.01)

(52) U.S. Cl.
USPC ..... 292/57; 292/95; 292/113; 292/121; 292/216

(58) Field of Classification Search
USPC ..... 292/57, 58, 63, 64, 67, 95, 96, 100, 292/101, 113, 121, 122, 126, 128, 216, 292/DIG. 4
See application file for complete search history.

(56) References Cited

U.S. PATENT DOCUMENTS 5,090,751 A * 2/1992 Kobayashi ..... 292/71
5,775,748 A * 7/1998 Kurachi ..... 292/341.15

(Continued)

FOREIGN PATENT DOCUMENTS

| | | | |
|---|---|---|---|
| EP | 1 304 436 | A2 | 4/2003 |
| EP | 2 026 689 | | 2/2009 |
| GB | 2 397 095 | A | 7/2004 |
| WO | WO 2007/140755 | A1 | 12/2007 |

OTHER PUBLICATIONS

International Search Report issued in PCT Application No. PCT/IT2010/000426 on Apr. 21, 2011.

*Primary Examiner* — Carlos Lugo
(74) *Attorney, Agent, or Firm* — Abe Hershkovitz; Hershkovitz & Associates, PLLC

(57) ABSTRACT

A door-locking device for locking a door of a household appliance, the door providing a closure hook, and at least a gasket provided on the door and/or on the household appliance. The device providing a locking hook, coupling with the household appliance closure hook, a slider, movable along a direction substantially parallel to a household appliance wall on which the door is provided, a recovery lever compensating for clearance of the gasket sealing closure, and a mechanical coupling for the locking hook and the recovery lever, the locking hook being rotably coupled with the mechanical coupling and being movable according to a direction substantially perpendicular with respect to the movement direction of the slider, an elastic arm being further provided in a second embodiment, aiming to maintain the mechanical coupling in a door closure position, and interaction elements arranged between the slider and the mechanical coupling for locking each other in the door closure position.

13 Claims, 8 Drawing Sheets

(56) References Cited

U.S. PATENT DOCUMENTS

| | | | | |
|---|---|---|---|---|
| 5,997,056 | A * | 12/1999 | Yamagishi | 292/341.17 |
| 6,155,616 | A * | 12/2000 | Akright | 292/207 |
| 7,306,266 | B2 * | 12/2007 | Hapke et al. | 292/218 |
| 7,347,460 | B2 * | 3/2008 | Ala | 292/216 |
| 7,775,565 | B2 * | 8/2010 | Hartmann et al. | 292/60 |
| 8,152,207 | B2 * | 4/2012 | Hartmann et al. | 292/95 |
| 8,376,418 | B2 * | 2/2013 | Osvatic et al. | 292/216 |
| 2002/0073752 | A1 * | 6/2002 | Dirnberger et al. | 70/266 |

* cited by examiner 16
15
1
17
4
14
2
6
5
3
8
7

16
1
17
2
10
12
13
5
3
8
7

2
16
15
1
17
B ⟷ A
10
12
13
6
3
7
8

DOOR-LOCKING DEVICE FOR LOCKING THE DOOR OF HOUSEHOLD APPLIANCE

CROSS-REFERENCE TO RELATED APPLICATIONS

This application is a continuation of PCT/IT2010/000426 filed 21 Oct. 2010, which claims priority under 35 USC §119 to Italian Application No. RM2009A000622 filed Nov. 26, 2009.

BACKGROUND OF THE INVENTION

1. Field of the Invention

The present invention relates to a door-locking device for locking the door of a household appliance, particularly a washing machine.

More specifically, the invention relates to a door-locking device permitting compensating possible clearances due to gasket wearing and/or to stresses caused by household appliance operation.

2. Description of the Related Art

As it is well known, the need exists to have available a door-locking device for a washing machine permitting maintaining the washing machine door closed, by compensating closure clearances due for example to closure gasket deterioration caused by its ageing.

Furthermore, there exists the need to have the possibility of compensating possible clearances of door closure when the washing machine is working, particularly under full load conditions, said clearances causing problems since stresses of a basket on the inner surface of the door can cause water leakage around the gasket, and more generally deterioration of the quality of the same closure.

Different solutions have been suggested during recent years, all aiming at solving this kind of problem.

However, even though they can compensate for the above clearances, none of the known solutions can provide a fully satisfying solution to the above mentioned need.

SUMMARY OF THE INVENTION

In view of the above, the Applicant has realised and prepared a new door-locking device for the washing machine door that can satisfy all the above requirements, permitting a full recovery of possible clearances either due to gasket ageing or to stresses caused by full load washing machine operation.

It is therefore a specific object of the present invention to provide a door-locking device for locking the door of a household appliance, said door providing a closure hook, and at least a gasket provided on said door and/or on said household appliance, said device being characterised in that it provides a locking hook, coupling with said household appliance closure hook, a slider, movable along a direction substantially parallel to the household appliance wall on which the door is provided, a lever compensating clearance of said gasket sealing closure, and kinematic means coupling said locking hook and said recovery lever, said locking hook being rotably coupled with said kinematic means and being movable according to a direction substantially perpendicular with respect to the movement direction of said slider, elastic means being further provided, aiming at maintaining said kinematic means in a door closure position, and interaction means between said slider and said kinematic means for locking the position of each other in the door closure position.

Preferably, according to the invention, said device is provided with means for locking the same in the closure position, said locking means being de-activated only after de-activation of the household appliance operation.

Particularly, according to the invention, said locking means is comprised of a locking pin, acting on said slider.

Preferably, said kinematic connection between the lever hook is realised by a shaped element, providing on the front portion a seat for coupling the rotation hook and centrally a sliding seat for said slider.

Particularly, said interaction means between said slider and said kinematic means for locking the position of each other in the door closure position are comprised of two projections provided on said slider and on said shaped element interacting in the different device operative steps.

Always according to the invention, said elastic means is comprised of a spring.

Still according to the invention, said locking hook rotates about a pin provided on said kinematic means, and it is provided above with an appendix slidably movable within a slot realised on said slider, and at the bottom with a slot for coupling with the door closure hook.

Preferably, said slot realised on said slider is longer than said appendix, so as to permit recovery of clearance.

In a preferred embodiment of the device according to the invention, mechanical means are provided for reducing an angular stroke of the kinematic means when said locking means is active.

Preferably, according to the invention, said mechanical means is comprised of a relief on said slider, in order to reduce a stroke of said mechanical means when said locking means is active, thus reducing maximum excursion of a door movement when the household appliance is operating, said relief reducing the angle of kinematic means that will be active only when said locking means is in an operative position.

Particularly, said relief has a triangular shape, and it is realised on said slider, being an integral part of the same by an elastic arm, permitting a rearward movement, on said kinematic means being that it is provided an angle-shaped seat, having an inner surface able to interact with an angled surface of a triangular relief when said slider is in a forward position (door closed), or comprised of any other element carrying out the same function.

In a preferred embodiment of the device according to the invention, it comprises a hook, a slider, a clearance recovery lever, a spring and a locking pin, interacting with a corresponding seat realised under the slider, said lever being rotatably pivoted on a pin, provided on said base element, kinematic connection between hook and lever being realised by a shaped element, providing a coupling seat in the front portion for the rotation pin, and centrally a slider sliding seat, slider and shaped element being provided with two projections, interacting during the different steps of the device operation.

In lieu of the above mentioned relief, it can be provided with every kind of mechanism permitting reducing the angular stroke of the shaped element (lever arm) when the locking pin is active.

BRIEF DESCRIPTION OF THE DRAWINGS

The present invention will be now described, for illustrative, but not limitative purposes, according to a preferred embodiment, with particular reference to the enclosed drawings, wherein.

DETAILED DESCRIPTION OF THE INVENTION

Figure 1A:
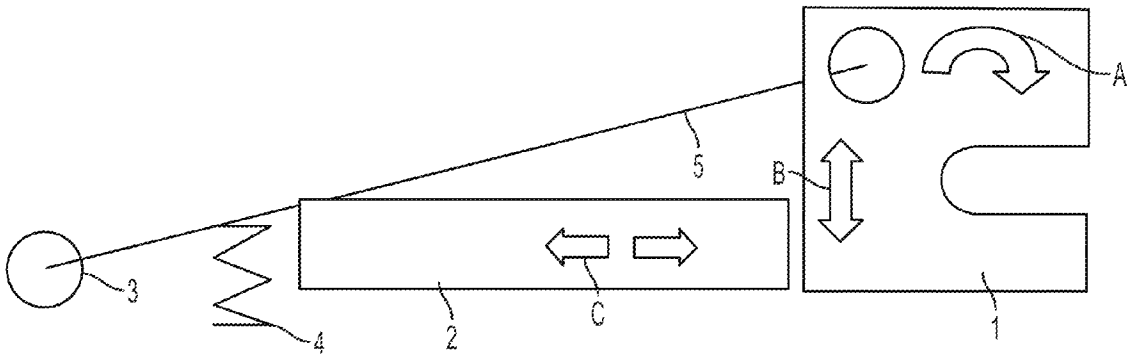
FIGS. 1*a* and 1*b* show the general scheme of the door-locking device according to the invention, respectively with the door closed and compensation for a more or less large clearance.

Observing first FIGS. 1 and 2, it is generically shown the operative principle of the door-locking device according to the invention.

In the various figures there are generically shown a hook 1, a slider 2, a spring 4, a clearance recovery lever 3 and a mechanical coupling 5 between the hook 1 and the lever 3. Hook 1 is movable according to the direction of arrow A, during the door (not shown) closure and opening, and according to arrow B, for compensating clearances.

Figure 1B:
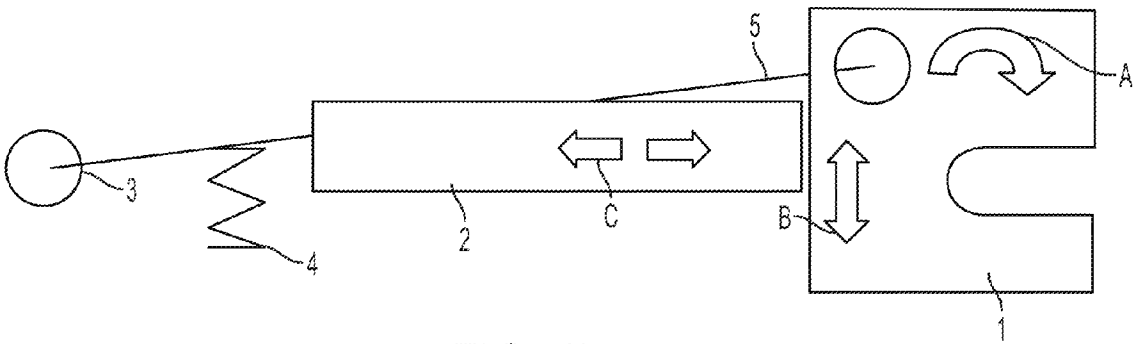

For example, FIGS. 1*a* and 1*b* show door-locking in a closure configuration, in two positions. The above puts into evidence that the door-locking device can close (recovery) at different heights.

Slider 2 instead can move according to arrow C.

Spring 4 will be compressed when the door is open and extended when the door is closed. (Spring 4 in every position acts to maintain the recovery lever 3 open, said spring 4 could be a torsion or traction spring).

Figure 2A:
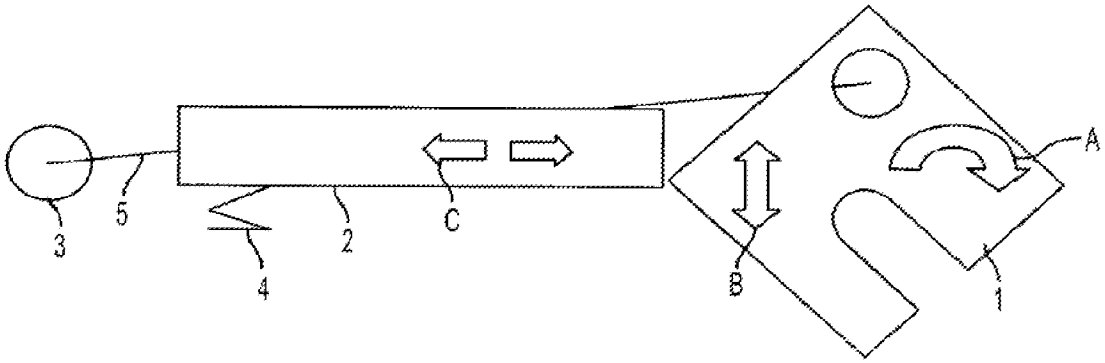
FIGS. 2*a* and 2*b* show a scheme of FIG. 1, respectively in an opening condition and in an opening attempt, with the locking pin activated.
Figure 2B:
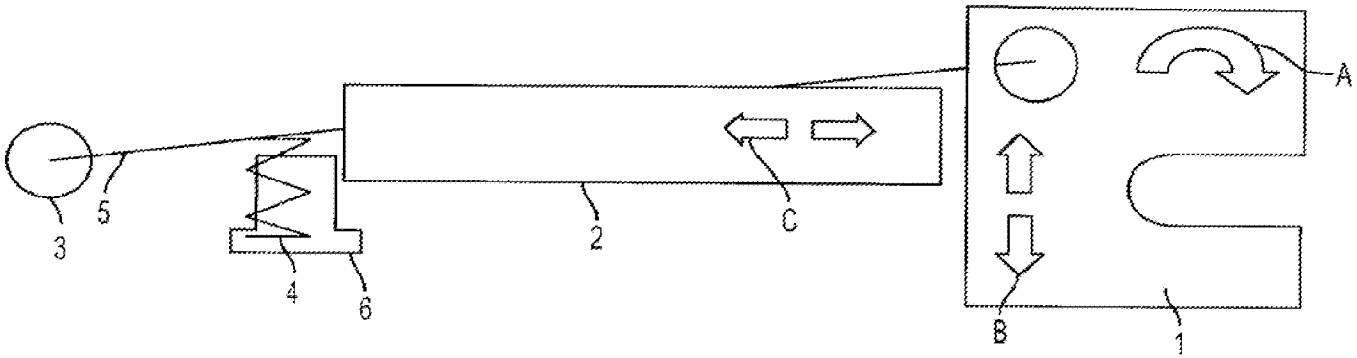

Operation of the device according to the invention is shown in FIGS. 2*a* and 2*b*, respectively in an opening and closure position. Locking pin 6 is shown in FIG. 2*b*, preventing opening of the door while the household appliance is working.

Figure 3:
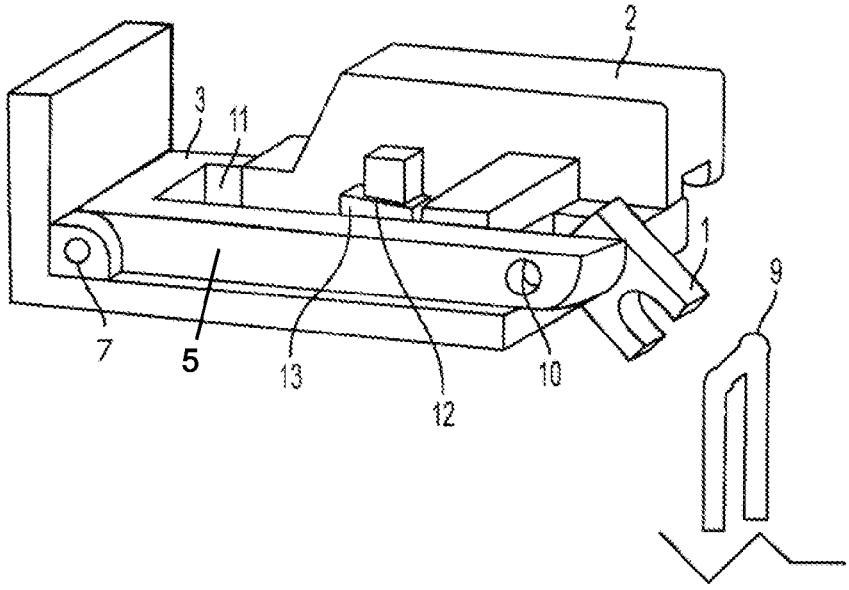
FIG. 3 generically shows a perspective view of a device according to the invention.
Figure 4:
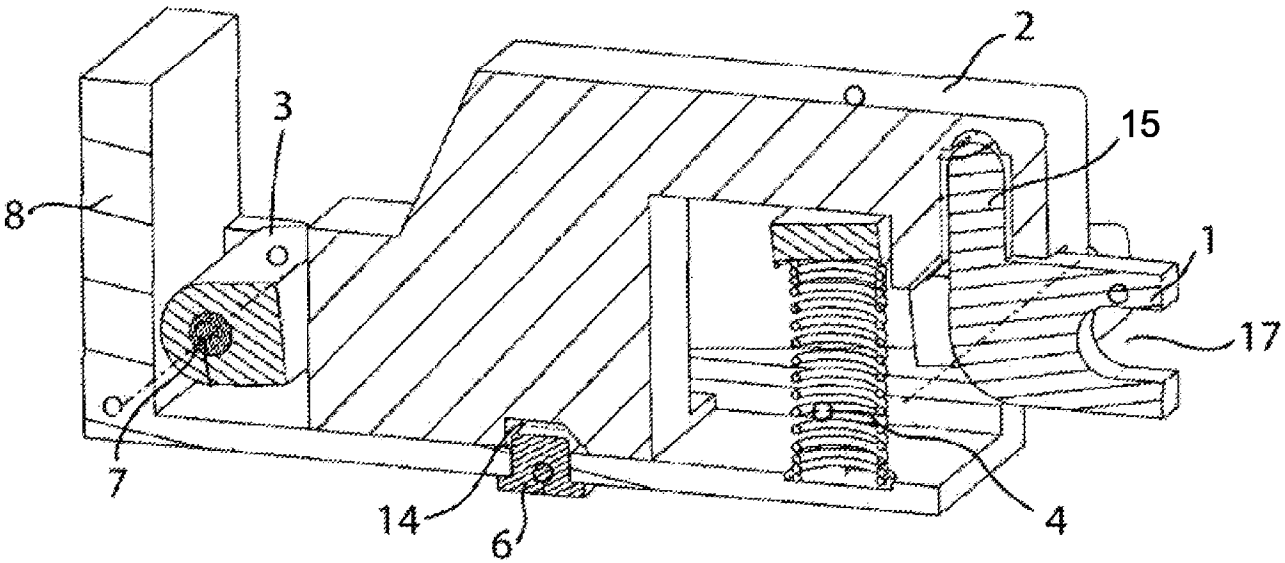
FIG. 4 is a vertical section longitudinal view of the device of FIG. 3, with the different components indicated.

Observing now the other figures of the enclosed drawings, and at first FIGS. 3 and 4, it is shown an embodiment of the door-locking device according to the invention, providing hook 1, slider 2, clearance recovery lever 3, spring 4 and locking pin 6, interacting with a corresponding seat 14 realised under the slider 2 in FIG. 4.

Said lever 3 is pivoted on pin 7, supported by base element 8.

Kinematic coupling between hook 1 and lever 3 is realised in FIGS. 1 and 2 by a shaped element which is the mechanical coupling (generically indicated by reference number 5). In FIG. 3, there is provided a front seat 10 for coupling of a rotation pin for the hook 1 and a central sliding seat 11 for the slider 2.

A door hook 9 of the washing machine (not shown) is also seen in FIG. 3.

Slider 2 and mechanical coupling 5 are provided in FIG. 3 with two projections, respectively 12 and 13, interacting during the various operation steps, as it will be evident from the following specification.

Figures 5A, 5B, 5C:
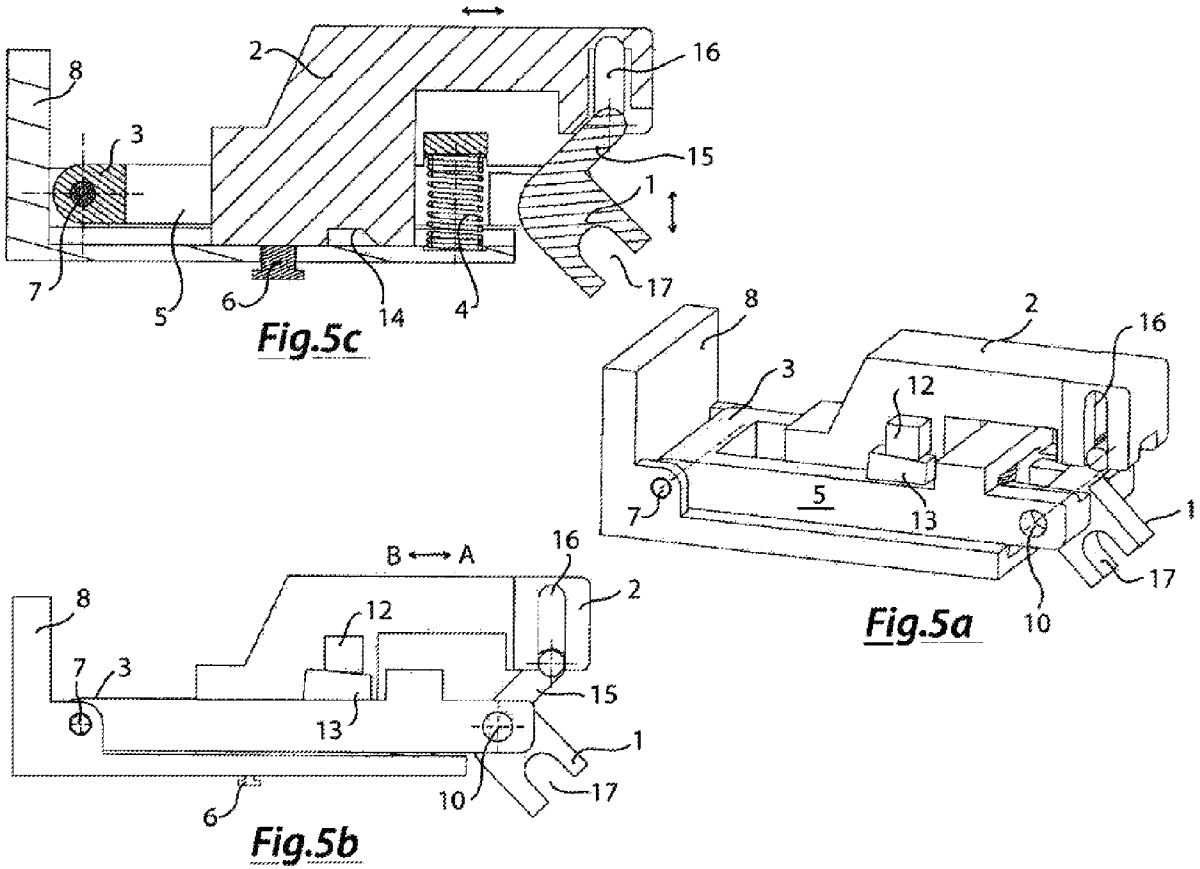
FIGS. 5*a*-5*c* respectively show, in a perspective, lateral and section view, the device according to the invention with the door open.

Hook 1 rotates in FIG. 3 about a pin in the front seat 10 on the mechanical coupling 5, the hook 1 is provided in FIG. 4 with an appendix 15, sliding in FIGS. 5*b* and 5*c* within a slot 16 realised in the slider 2, and the hook 1 is also provided with a coupling slot 17 for the door hook 9, seen only in FIG. 3.

Appendix 15 in FIGS. 5*b* and 5*c* can move within the slot 16 so as to permit its recovery.

Operation of the door-locking device according to the invention will be described in the following.

Observing first FIG. 5, the device according to the invention is seen with the door open. Hook 1 is free from coupling with the hook 9 (not shown in this figure but see FIG. 3) of the door. Two projections 12 and 13 in FIGS. 5*a* and 5*b* are positioned one above the other one. Spring 4 is compressed in FIG. 5*c*. Locking pin 6 in FIG. 5*c* does not interact with the seat 14, and the appendix 15 of the hook 1 is substantially at one end of the slot 16 of the slider 2.

Figure 6A:
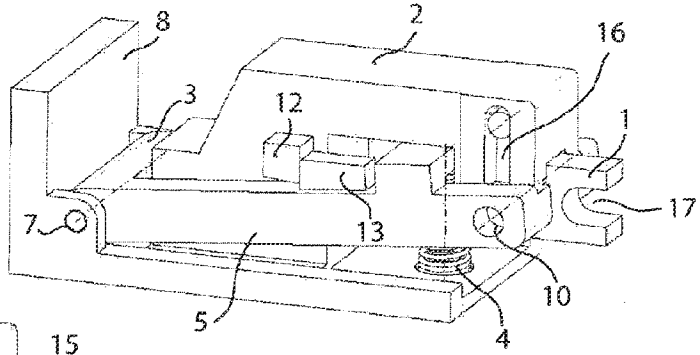
FIGS. 6*a*-6*c* respectively show, in a perspective, lateral and section view, the device according to the invention with the door locked.
Figure 6B:
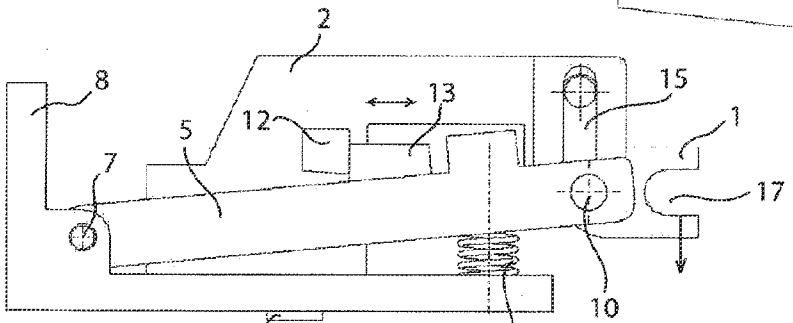
Figure 6C:
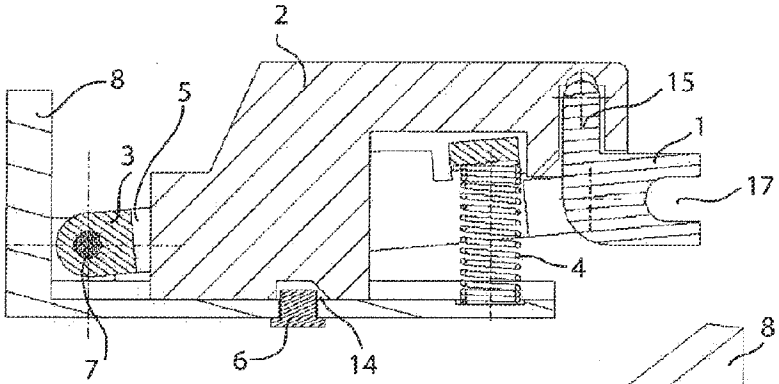

When the door is closed (see particularly FIG. 6), the door hook 9 (not shown in this figure but see FIG. 3) of the door couples in FIGS. 6*a*, 6*b* and 6*c* with the slot 17 of the hook 1, making the hook 1 rotate in FIGS. 6*a* and 6*b* about the pin in the seat 10. Appendix 15 in FIGS. 6*b* and 6*c* slides within the slot 16 seen in FIG. 6*a*, rising and forcing the slider 2 to move, leftward in the figure, with respect to the mechanical coupling 5.

During movement of the slider 2 in FIG. 6*a*, the projection 12 moves sliding along the projection 13, until freeing itself from the same. Now, the spring 4 pushes the mechanical coupling 5 upward, forcing the position of the hook 1 down with respect to the slider 2, as seen in FIG. 6*b*.

While moving leftward in FIG. 6*c*, the slider 2 brings the seat 14 in to correspondence with the locking pin 6, thus coupling with the same seat 14.

Kinematism caused by the hook 1, slider 2, coupling 5, lever 3 and spring 4 is such to permit hermetic closure of the door, recovering the clearance due to gasket wearing of stresses caused by operation of the door.

Figures 7A, 7B, 7C:
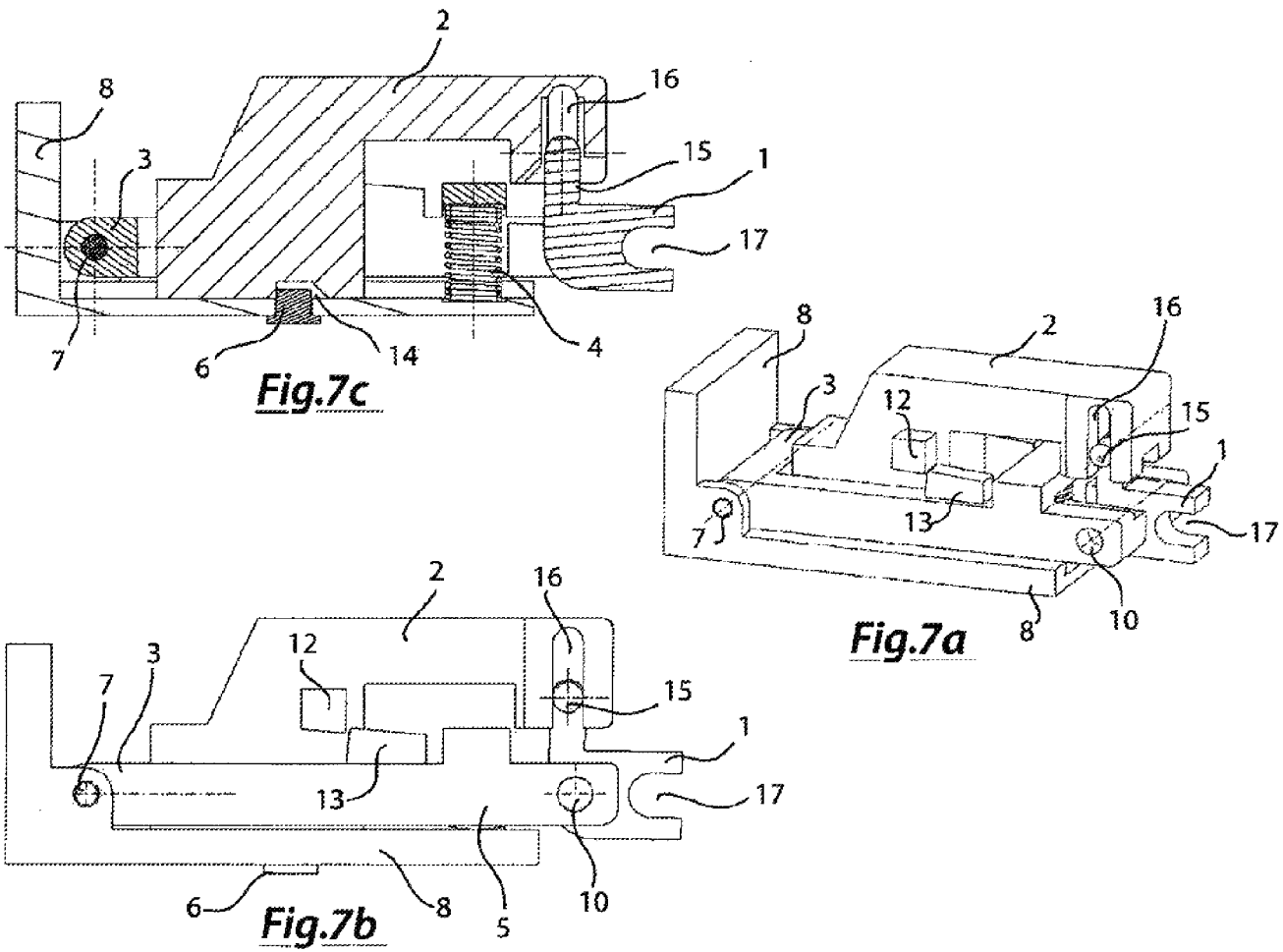
FIGS. 7*a*-7*c* respectively show, in a perspective, lateral and section view, the device according to the invention in an attempt at opening the door when the washing machine is operating.

In case someone attempts opening the door when the washing machine is working (see FIG. 7), coupling between the locking pin 6 and the seat 14 in FIG. 7*c* is such to permit only a partial movement of the hook 1, namely the appendix 15 without permitting complete release.

Locking pin 6 is released only at the end of the washing cycle, when it will be possible to open the door.

Opening of the door is very easy. Acting on the door, a user makes the hook 1 go downward, causing a sliding of the slider 2 rightward in the FIG. 7*b*, with a consequent lowering of the mechanical coupling 5 and interaction between two projections 12 and 13, and consequent compression of the spring 4 seen in FIG. 7*c*.

Figure 8:
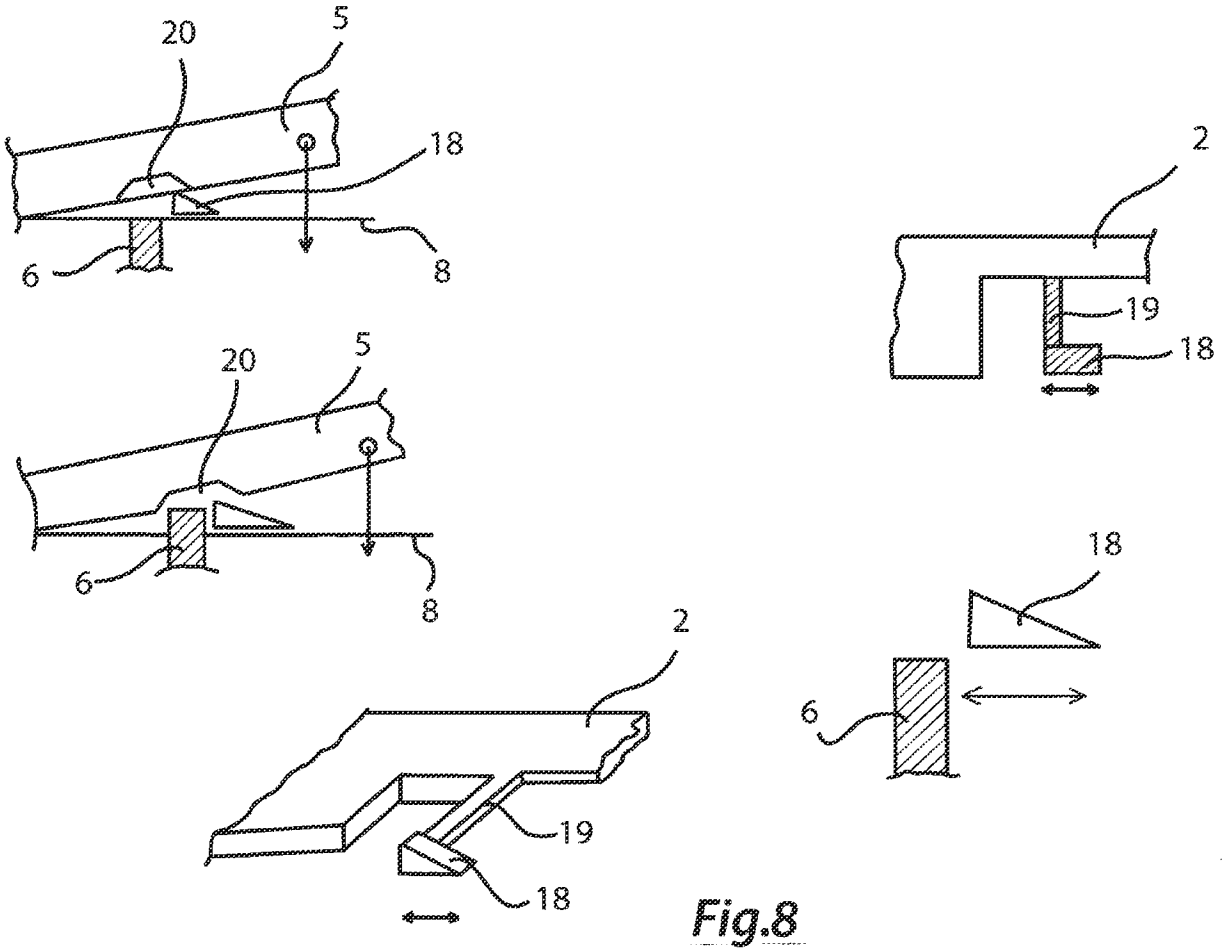
FIG. 8 shows a particular view of a preferred embodiment of the invention.

Observing now the embodiment of FIG. 8, a relief 18 is provided on the slider 2, aiming at reducing a stroke of the mechanical coupling 5 when the locking pin 6 is in an active (raised) position, in order to reduce a maximum stroke of door movement when the washing machine is working, thus limiting a recovery stroke.

Said relief 18 reduces the angle between the mechanical coupling 5 that will be active only when the locking pin 6 is in an operative position.

In the embodiment shown in FIG. 8, the relief 18 has a triangular shape and it is part of the slider 2, being integral with the same by an elastic arm 19, permitting a rearward movement. The mechanical coupling 5 has an angle-shaped seat 20, having an inner surface that can interact with an angled surface of the triangular relief 18 when the slider 2 is in an advanced position (door closed). In such a condition, movement of the triangular relief 18 is such to at least partly juxtapose on the locking pin 6 when the slider 2 is in a rest position.

When the door hook 9 of FIG. 3 is engaged with the locking hook 1, the slider 2 is moved leftward on the sheet, and the locking pin 6 of FIG. 4 is in a rest position. In case the mechanical coupling 5 (which is seen in FIG. 3 as an arm of the clearance recovery lever 3) is stressed (dragged by opening of the door), the angle-shaped seat 20 in FIG. 8 interacts with the triangular relief 18, pushing the slider 2 backward (because the arm 19 connected to the relief 18 is an elastic one), thus receiving the relief 18 inside the seat 20.

Thus, lever arm 3, as seen in FIG. 3, can even take a 0° angle with respect to the frame (or more generally, it can make the full stroke).

Under operative conditions, the door hook 9 of FIG. 3 is engaged with the locking hook 1, the slider 2 of FIG. 8 is set in position, but the locking pin 6 is in an operative position (outside of the seat 20). In case the mechanical coupling 5 (as the arm of the lever 3 in FIG. 3) is stressed (always in a traction mode, during an opening attempt), the angle-shaped seat 20 of FIG. 8 interacts with the triangular relief 18, trying to push the slider 2 backward, but the locking pin 6 prevents its backward movement, so that the triangular relief 18 interposes (acting as a thickness) itself between the mechanical coupling 5 and the base element 8, thus reducing movement in an angular range (larger than 0°).

Any other mechanism can be provided in FIG. 8 in lieu of the above relief 18, as long as it is capable of permitting reducing of the angular stroke of the mechanical coupling 5 when the locking pin 6 is active.

The present invention has been described for illustrative but not limitative purposes, according to its preferred embodiments, but it is to be understood that modification and/or variations can be introduced by those skilled in the art without departing from the relevant scope as defined in the appended claims.

The invention claimed is:

1. A door-locking device comprising:

a locking hook having at one end a coupling slot configured to engage a door closure hook and also having a slidable appendix at an opposite end;

a slider having at one end a slot configured to receive the appendix therein and also having a seat formed thereunder;

a locking pin configured to engage the seat and stop movement of the slider when the slider moves over the pin;

a clearance recovery lever;

a mechanical coupling configured to connect the locking hook to the lever; and a spring configured to push the mechanical coupling upwardly;

wherein said locking hook is rotatably coupled with said mechanical coupling and movable between an opening position, where said locking hook is disengaged from said door closure hook, and a closing position, where said locking hook is engaged with said door closure hook; and wherein said appendix of said locking hook is movable in a direction substantially perpendicular with respect to said slot.

2. The door-locking device according to claim 1, wherein the mechanical coupling has a front seat configured to couple with the locking hook.

3. The door-locking device according to claim 1, wherein the mechanical coupling has a central seat configured to receive the slider.

4. The door-locking device according to claim 1, wherein the mechanical coupling has a projection mounted thereon.

5. The door-locking device according to claim 4, wherein the slider has mounted on a side thereof a projection configured to interact with the projection mounted on the mechanical coupling.

6. The door-locking device according to claim 1, further comprising:

a base element configured to support the lever.

7. The door-locking device according to claim 6, further comprising:

a pivoting pin mounted on the base element and configured to allow rotation of the lever thereabout.

8. The door-locking device according to claim 1, wherein the mechanical coupling has a seat formed thereunder and configured to receive the locking pin.

9. The door-locking device according to claim 8, wherein the slider has mounted on a side thereof a relief piece configured to interact with the seat formed under the mechanical coupling.

10. The door-locking device according to claim 9, wherein the relief piece has a triangular shape.

11. The door-locking device according to claim 9, wherein the slider includes an elastic arm configured to connect the relief piece thereto.

12. The door-locking device according to claim 11, wherein the relief piece has a triangular shape.

13. A door-locking device comprising:

a locking hook having at one end a coupling slot configured to engage a door closure hook and also having a slidable appendix at an opposite end;

a slider having at one end a slot configured to receive the appendix therein and also having a seat formed thereunder;

a locking pin configured to engage the seat and stop movement of the slider when the slider moves over the pin;

a clearance recovery lever;

a mechanical coupling configured to connect the locking hook to the lever; and a spring configured to push the mechanical coupling upwardly;

wherein said locking hook is movable between an opening position, where said locking hook is disengaged from said door closure hook, and a closing position, where said locking hook is engaged with said door closure hook; and wherein said appendix of said locking hook is movable in a direction substantially perpendicular with respect to said slot.

* * * * *